US010431171B2

(12) United States Patent
Kim et al.

(10) Patent No.: US 10,431,171 B2
(45) Date of Patent: Oct. 1, 2019

(54) DISPLAY DEVICE AND METHOD FOR DRIVING THE SAME

(71) Applicant: SAMSUNG DISPLAY CO., LTD., Yongin-si, Gyeonggi-do (KR)

(72) Inventors: Heendol Kim, Yongin-si (KR); Jaihyun Koh, Yongin-si (KR); Bonghyun You, Seongnam-si (KR); Jaehoon Lee, Seoul (KR); Dongwon Park, Gangneung-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 53 days.

(21) Appl. No.: 15/665,935

(22) Filed: Aug. 1, 2017

(65) Prior Publication Data

US 2018/0033384 A1 Feb. 1, 2018

(30) Foreign Application Priority Data

Aug. 1, 2016 (KR) ..... 10-2016-0097840

(51) Int. Cl.
*G09G 3/36* (2006.01)

(52) U.S. Cl.
CPC ..... *G09G 3/3614* (2013.01); *G09G 3/3648* (2013.01); *G09G 2310/027* (2013.01); *G09G 2310/0289* (2013.01); *G09G 2310/08* (2013.01); *G09G 2320/0209* (2013.01); *G09G 2330/06* (2013.01)

(58) Field of Classification Search
CPC ..... G09G 3/3614; G09G 3/3648; G09G 2310/027; G09G 2320/0209; G09G 2330/06
See application file for complete search history.

(56) References Cited

U.S. PATENT DOCUMENTS

| | | | | |
|---|---|---|---|---|
| 7,893,900 | B2 | 2/2011 | Kim et al. | |
| 8,988,335 | B2 | 3/2015 | Jang et al. | |
| 9,646,560 | B2 | 5/2017 | Kim et al. | |
| 2004/0070581 | A1* | 4/2004 | Hiraki | G09G 3/2011 345/209 |
| 2014/0092077 | A1* | 4/2014 | Kim | G09G 3/3611 345/212 |
| 2015/0054809 | A1* | 2/2015 | Lim | G09G 3/3696 345/211 |
| 2016/0033113 | A1 | 2/2016 | Nadershahi et al. | |

FOREIGN PATENT DOCUMENTS

| | | | |
|---|---|---|---|
| KR | 1020060000232 | A | 1/2006 |
| KR | 1020080002140 | A | 1/2008 |
| KR | 1020150142153 | A | 12/2015 |

* cited by examiner

*Primary Examiner* — Towfiq Elahi
(74) *Attorney, Agent, or Firm* — Cantor Colburn LLP

(57) ABSTRACT

A method includes applying a common voltage to a display panel, digitally converting a feedback common voltage from the display panel, detecting an effective ripple signal exceeding a reference value based on the digitally converted feedback common voltage, comparing a total number of effective ripple signals detected during a first frame period with a threshold value, determining whether the effective ripple signals of the first frame period are crosstalk inducing signals based on a comparison result, and determining whether to change a polarity pattern of image data signals to be applied to the display panel during a second frame period based on a determination result in terms of the crosstalk inducing signal.

20 Claims, 15 Drawing Sheets

DISPLAY DEVICE AND METHOD FOR DRIVING THE SAME

This application claims priority to Korean Patent Application No. 10-2016-0097840, filed on Aug. 1, 2016, and all the benefits accruing therefrom under 35 U.S.C. § 119, the content of which in its entirety is herein incorporated by reference.

1. FIELD

Exemplary embodiments of the invention relate to a display device, and more particularly, to a display device capable of substantially preventing crosstalk and to a method of driving the display device.

2. DISCUSSION OF RELATED ART

A liquid crystal display ("LCD") device is one of the most widely used flat panel display ("FPD") devices, and generally includes two substrates on which electrodes are formed and a liquid crystal layer interposed therebetween.

The LCD device adjusts an amount of transmitted light by applying voltages respectively to two electrodes to rearrange liquid crystal molecules in the liquid crystal layer.

SUMMARY

In a liquid crystal display ("LCD") device, when an image of a certain pattern is displayed, a common voltage may be distorted, which may result in crosstalk.

Exemplary embodiments according to the invention may be directed to a display device capable of substantially preventing crosstalk and to a method of driving the display device.

According to an exemplary embodiment, a method of driving a display device includes applying a common voltage to a display panel, digitally converting a feedback common voltage from the display panel, detecting an effective ripple signal exceeding a reference value based on the digitally converted feedback common voltage, comparing a total number of effective ripple signals detected during a first frame period with a threshold value, determining whether the effective ripple signals of the first frame period are crosstalk inducing signals based on a comparison result, and determining whether to change a polarity pattern of image data signals to be applied to the display panel during a second frame period based on a determination result in terms of the crosstalk inducing signal.

In an exemplary embodiment, the digitally converting the feedback common voltage may include sampling the feedback common voltage n number of times (n being a natural number greater than 1) in each horizontal period of the first frame period to generate n number of sampling voltages in one horizontal period.

In an exemplary embodiment, the detecting the effective ripple signal exceeding the reference value may include individually comparing each of the n number of sampling voltages with the reference value in each horizontal period of the first frame period, and detecting the effective ripple signal exceeding the reference value in each horizontal period based on the comparison result between each of the n number of sampling voltages and the reference value.

In an exemplary embodiment, the reference value may include an upper limit reference value having a value greater than the common voltage, and a lower limit reference value having a value less than the common voltage.

In an exemplary embodiment, the individually comparing of each of the n number sampling voltages with the reference value in each horizontal period of the first frame period may include comparing each of the n number of sampling voltages with one of the upper limit reference value and the lower limit reference value in each horizontal period, and comparing each of the n number of sampling voltages with the other of the upper limit reference value and the lower limit reference value in each horizontal period.

In an exemplary embodiment, the detecting the effective ripple signal exceeding the reference value may include detecting, when any one of the n number of sampling voltages is greater than the upper limit reference value or less than the lower limit reference value, the effective ripple signal in a corresponding horizontal period.

In an exemplary embodiment, the determining whether the effective ripple signals of the first frame period are crosstalk inducing signals may include counting the total number of effective ripple signals in each horizontal period of the first frame period, and comparing the total number of counted effective ripple signals with the threshold value.

In an exemplary embodiment, the determining whether the effective ripple signals of the first frame period are crosstalk inducing signals may further include determining that the effective ripple signals of the first frame period are the crosstalk inducing signals when the total number of the counted effective ripple signals reaches the threshold value.

In an exemplary embodiment, the detecting the effective ripple signal exceeding the reference value may include adding all of the n number of sampling voltages in one horizontal period to generate a sum sampling voltage, generating a sum common voltage which is n times the common voltage, generating a difference voltage corresponding to an absolute value of a difference between the sum sampling voltage and the sum common voltage, comparing the difference voltage with the reference value, and detecting the effective ripple signal exceeding the reference value in each horizontal period based on a comparison result between the difference voltage and the reference value.

In an exemplary embodiment, the detecting the effective ripple signal exceeding the reference value may further include detecting, when the difference voltage is greater than the reference value, the effective ripple signal in a corresponding horizontal period.

According to another exemplary embodiment, a method of driving a display device includes applying a common voltage to a display panel of the display device, digitally converting a feedback common voltage from the display panel, detecting an effective ripple signal exceeding a reference value based on the digitally converted feedback common voltage, detecting an iterative ripple pattern from effective ripple signals detected during a first frame period, comparing a total number of iterative ripple patterns detected during the first frame period with a threshold value, determining whether the effective ripple signals of the first frame period are crosstalk inducing signals based on a comparison result, and determining whether to change a polarity pattern of image data signals to be applied to the display panel during a second frame period based on a determination result in terms of the crosstalk inducing signal.

In an exemplary embodiment, the determining whether the effective ripple signals of the first frame period are crosstalk inducing signals may include counting the total number of iterative ripple patterns during the first frame period, and comparing the total number of counted iterative ripple patterns with the threshold value.

In an exemplary embodiment, the determining whether the effective ripple signals of the first frame period are crosstalk inducing signals may further include determining that the effective ripple signals of the first frame period are the crosstalk inducing signals when the total number of the counted iterative ripple patterns reaches the threshold value.

According to another exemplary embodiment, a display device includes a display panel, a power supply which applies a common voltage to the display panel, an analog-digital converter ("ADC") which digitally converts a feedback common voltage from the display panel, a ripple detector which detects an effective ripple signal exceeding a reference value based on the feedback common voltage digitally converted by the ADC, a ripple counter which compares a total number of effective ripple signals detected by the ripple detector during a first frame period with a threshold value and determines whether the effective ripple signals of the first frame period are crosstalk inducing signals based on a comparison result, and a timing controller which determines whether to change a polarity pattern of image data signals to be applied to the display panel during a second frame period based on a determination result, from the ripple counter, in terms of the crosstalk inducing signal.

In an exemplary embodiment, the ADC may sample the feedback common voltage n number of times (n being a natural number greater than 1) in each horizontal period of the first frame period to generate n number of sampling voltages in one horizontal period.

In an exemplary embodiment, the ripple detector may include a comparator which individually compares each of the n number of sampling voltages with the reference value in each horizontal period of the first frame period, and a detector which detects an effective ripple signal exceeding the reference value in each horizontal period based on the comparison result from the comparator.

In an exemplary embodiment, the reference value may include an upper limit reference value having a value greater than the common voltage, and a lower limit reference value having a value less than the common voltage.

In an exemplary embodiment, the comparator may compare each of the n number of sampling voltages with one of the upper limit reference value and the lower limit reference value in each horizontal period, and compare each of the n number of sampling voltages with the other of the upper limit reference value and the lower limit reference value in each horizontal period.

In an exemplary embodiment, the ripple detector may include a sampling voltage summer which adds all of the n number of sampling voltages provided from the ADC in one horizontal period to generate a sum sampling voltage, a common voltage summer which receives the common voltage from the power supply to generate a sum common voltage which is n times the common voltage, a difference voltage generator which generates a difference voltage corresponding to an absolute value of a difference between the sum sampling voltage from the sampling voltage summer and the sum common voltage from the common voltage summer, a comparator which compares the difference voltage from the difference voltage generator with the reference value, and a detector which detects the effective ripple signal exceeding the reference value in each horizontal period based on the comparison result from the comparator.

According to another exemplary embodiment, a display device includes a display panel, a power supply which applies a common voltage to the display panel, an ADC which digitally converts a feedback common voltage from the display panel, a ripple detector which detects an effective ripple signal exceeding a reference value based on the feedback common voltage digitally converted by the ADC, a ripple pattern detector which detects an iterative ripple pattern from effective ripple signals detected by the ripple detector during a first frame period, a ripple pattern counter which compares a total number of iterative ripple patterns detected by the ripple pattern detector during the first frame period with a threshold value and determines whether the effective ripple signals of the first frame period are crosstalk inducing signals based on a comparison result, and a timing controller which determines whether to change a polarity pattern of image data signals to be applied to the display panel during a second frame period based on a determination result, from the ripple pattern counter, in terms of the crosstalk inducing signal.

The foregoing is illustrative only and is not intended to be in any way limiting. In addition to the illustrative exemplary embodiments and features described above, further exemplary embodiments and features will become apparent by reference to the drawings and the following detailed description.

BRIEF DESCRIPTION OF THE DRAWINGS

A more complete appreciation according to an exemplary embodiment will become more apparent by describing in detail exemplary embodiments thereof with reference to the accompanying drawings, in which.

DETAILED DESCRIPTION

Figure 1:
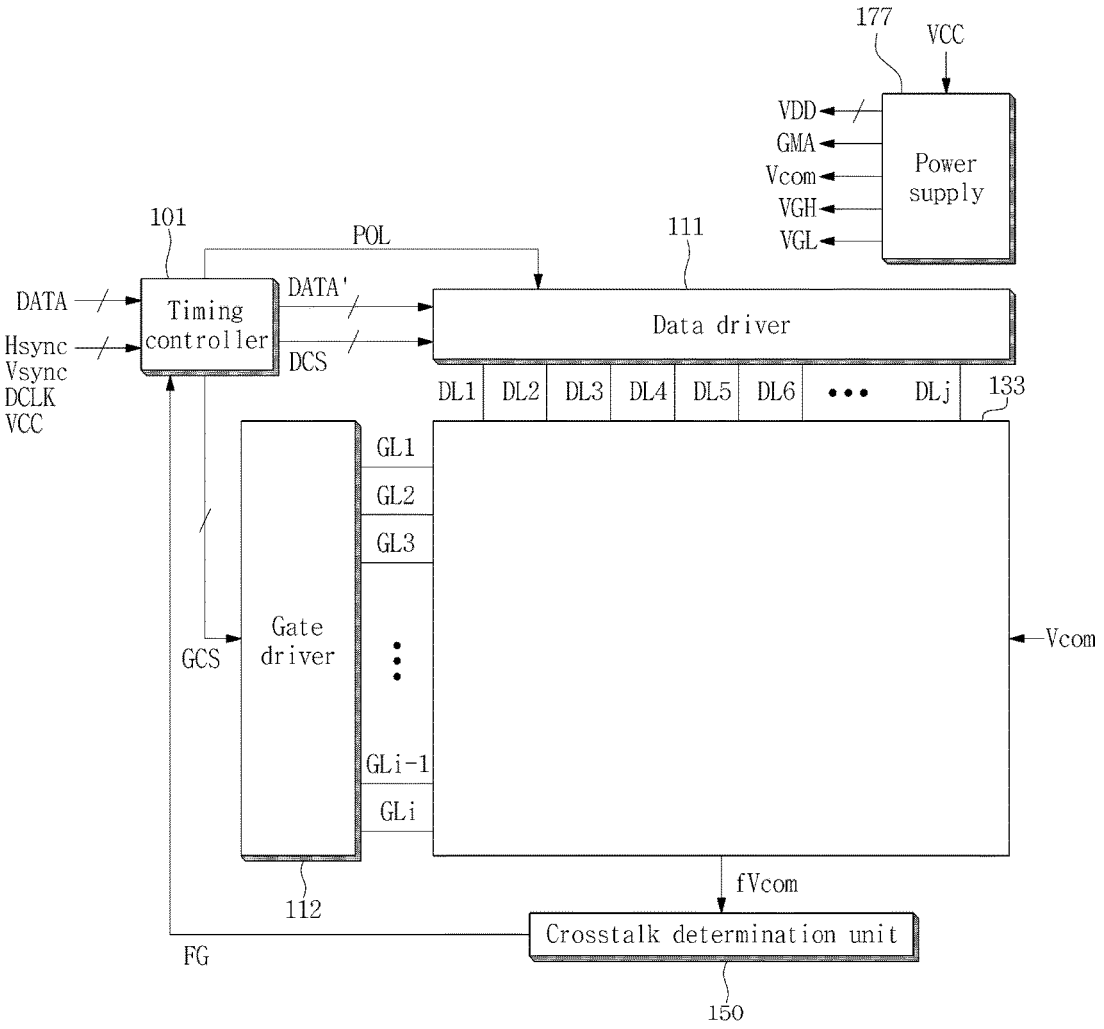
FIG. 1 is a block diagram illustrating an exemplary embodiment of a display device.

Exemplary embodiments will now be described more fully hereinafter with reference to the accompanying drawings. Although the invention may be modified in various manners and have several exemplary embodiments, exemplary embodiments are illustrated in the accompanying drawings and will be mainly described in the specification. However, the scope of the invention is not limited to the exemplary embodiments and should be construed as including all the changes, equivalents and substitutions included in the spirit and scope of the invention.

In the drawings, thicknesses of a plurality of layers and areas are illustrated in an enlarged manner for clarity and ease of description thereof. When a layer, area, or plate is referred to as being "on" another layer, area, or plate, it may be directly on the other layer, area, or plate, or intervening layers, areas, or plates may be present therebetween. Conversely, when a layer, area, or plate is referred to as being "directly on" another layer, area, or plate, intervening layers, areas, or plates may be absent therebetween. Further when a layer, area, or plate is referred to as being "below" another layer, area, or plate, it may be directly below the other layer, area, or plate, or intervening layers, areas, or plates may be present therebetween. Conversely, when a layer, area, or plate is referred to as being "directly below" another layer, area, or plate, intervening layers, areas, or plates may be absent therebetween.

The spatially relative terms "below", "beneath", "less", "above", "upper" and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in the other direction and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises," "comprising," "includes" and/or "including," when used in this specification, specify the presence of stated features, integers, steps, operations, elements and/or components, but do not preclude the presence or addition of one or more other features, integers, steps, operations, elements, components and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" may be termed likewise without departing from the teachings herein.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the specification.

Some of the parts which are not associated with the description may not be provided in order to specifically describe exemplary embodiments according to an exemplary embodiment and like reference numerals refer to like elements throughout the specification.

Hereinafter, a display device and a method of driving the display device will be described in detail with reference to FIGS. 1 to 14.

Figure 2:
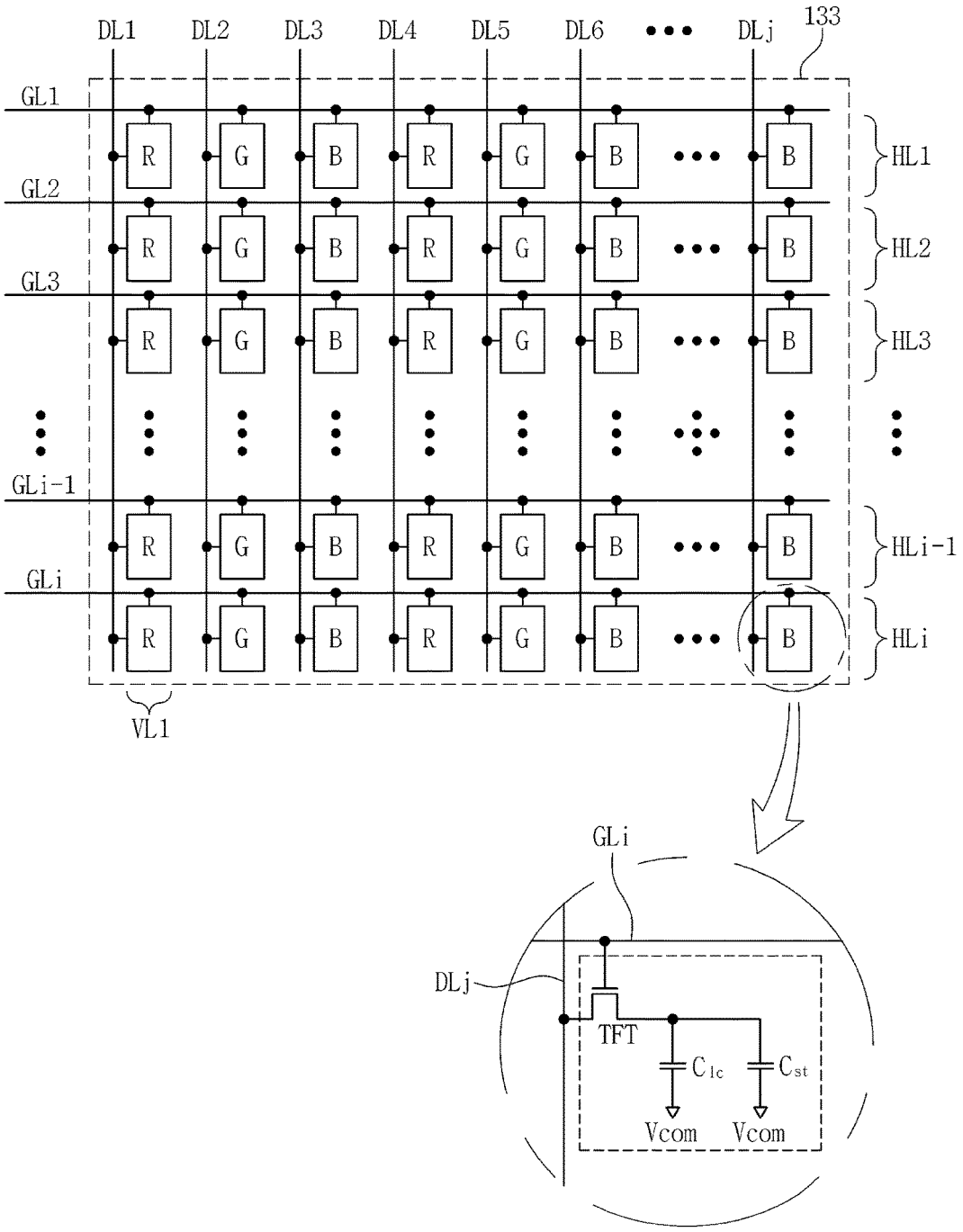
FIG. 2 is a detailed configuration view illustrating a display panel illustrated in FIG. 1.
Figure 3:
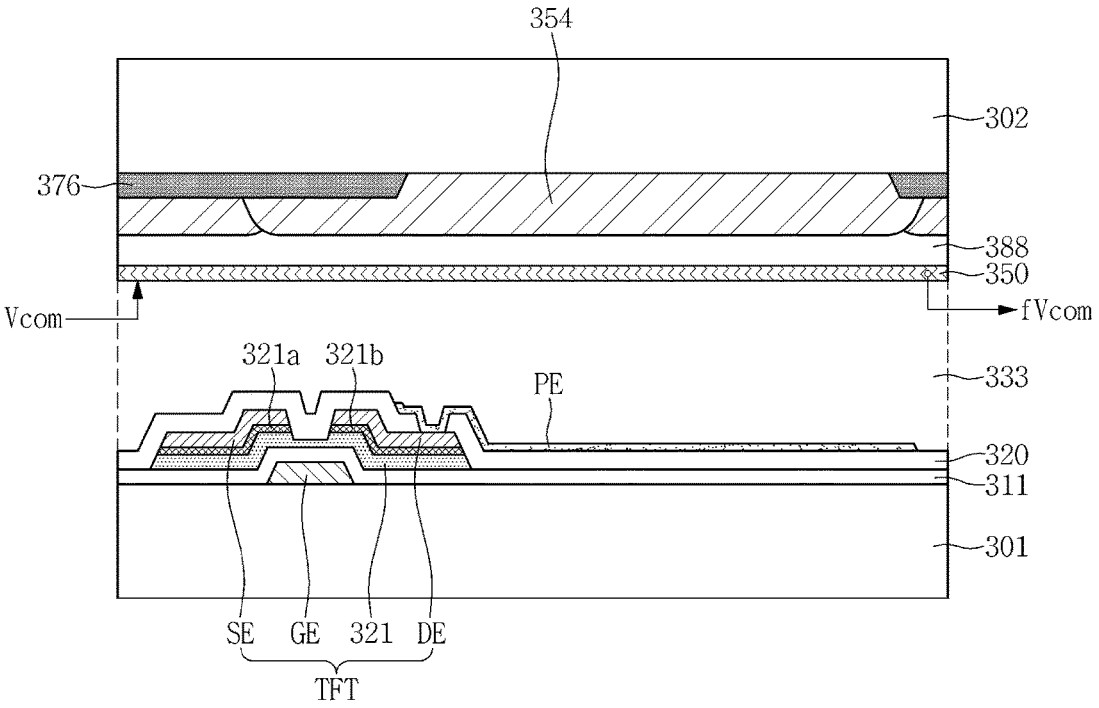
FIG. 3 is a cross-sectional view illustrating the display panel of FIG. 2.

FIG. 1 is a block diagram illustrating a display device according to an exemplary embodiment, FIG. 2 is a detailed configuration view illustrating a display panel illustrated in FIG. 1 and FIG. 3 is a cross-sectional view illustrating the display panel of FIG. 2.

As illustrated in FIG. 1, the display device includes a display panel 133, a timing controller 101, a gate driver 112, a data driver 111, a power supply 177 and a crosstalk determination unit 150.

The display panel 133 displays an image. In exemplary embodiments, the display panel 133 may be a liquid crystal display ("LCD") panel or an organic light emitting diode ("OLED") display panel, for example. Hereinafter, the display panel 133 is assumed to be an LCD panel by way of example.

As illustrated in FIG. 3, the display panel 133 includes a liquid crystal layer 333 and a lower substrate 301 and an upper substrate 302 facing each other with the liquid crystal layer 333 interposed therebetween.

As illustrated in FIG. 2, a plurality of gate lines GL1 to GLi, a plurality of data lines DL1 to DLj intersecting the gate lines GL1 to GLi, and thin film transistors ("TFTs") connected to the gate lines GL1 to GLi and the data lines DL1 to DLj are arranged on the lower substrate 301 where i and j are natural numbers.

As illustrated in FIG. 3, the thin film transistor ("TFT") includes a semiconductor layer 321, a gate electrode GE, a source electrode SE and a drain electrode DE.

The gate electrode GE is positioned on the lower substrate 301. The gate electrode GE is connected to one of the gate lines. The gate electrode GE and the gate line may be unitary.

The gate insulating layer 311 is positioned on the gate electrode GE and the gate lines GL1 to GLi.

The semiconductor layer 321 is positioned on the gate insulating layer 311 to overlap the gate electrode GE.

The source electrode SE is positioned on the semiconductor layer 321. The source electrode SE overlaps the gate electrode GE and the semiconductor layer 321. A first ohmic contact layer 321*a* may be further disposed between the source electrode SE and the semiconductor layer 321.

The drain electrode DE is positioned on the semiconductor layer 321. The drain electrode DE overlaps the gate electrode GE and the semiconductor layer 321. A second ohmic contact layer 321*b* may be further disposed between the drain electrode DE and the semiconductor layer 321.

A protective layer 320 is positioned on the source electrode SE and the drain electrode DE, and the protective layer 320 has a contact hole exposing the drain electrode DE.

A pixel electrode PE is positioned on the protective layer 320. The pixel electrode PE is connected to the drain electrode DE through the contact hole.

A plurality of color filters 354, an overcoat layer 388 and a common electrode 350 are positioned on the upper substrate 302. A light blocking layer 376 is positioned at a portion of the upper substrate 302 except for portions corresponding to respective pixel areas of pixels R, G and B. The color filters 354 are positioned in the pixel area. In an exemplary embodiment, the color filters 354 include a red color filter, a green color filter and a blue color filter, for example. However, the invention is not limited thereto, and color filters 354 may include various other color filters.

The common electrode 350 receives a common voltage Vcom from the power supply 177.

As illustrated in FIG. 2, the pixels R, G and B are arranged in a matrix form. The pixels R, G and B include red pixels R positioned corresponding to the red color filter, green pixels G positioned corresponding to the green color filter and blue pixels B positioned corresponding to the blue color filter. In such an exemplary embodiment, the red pixel R, the green pixel G and the blue pixel B adjacent to each other in a horizontal direction form a unit pixel for displaying one unit image.

There are "j" number of pixels arranged along a p-th (p being one selected from 1 to i) horizontal line (hereinafter, p-th horizontal line pixels) connected to the first to j-th data lines DL1 to DLj, respectively. Further, the p-th horizontal line pixels may be connected to a p-th gate line together. Accordingly, the p-th horizontal line pixels receive a p-th gate signal as a common signal. That is, "j" number of pixels arranged in a same horizontal line receives a same gate signal, while pixels arranged in different horizontal lines receive different gate signals, respectively. In an exemplary embodiment, the red pixel R, the green pixel G and the blue pixel B in a first horizontal line HL1 all receive a first gate signal, while the red pixel R, the green pixel G and the blue pixel B in a second horizontal line HL2 all receive a second gate signal having a different timing from a timing of the first gate signal, for example.

As illustrated in FIG. 2, each pixel R, G and B includes a thin film transistor TFT, a liquid crystal capacitor Clc and a storage capacitor Cst.

The thin film transistor TFT is turned on according to the gate signal applied from the gate line GLi. The turn-on thin film transistor TFT applies an analog image data signal provided from the data line DLj to the liquid crystal capacitor Clc and the storage capacitor Cst.

The liquid crystal capacitor Clc includes the pixel electrode PE and the common electrode 350 opposing each other.

The storage capacitor Cst includes the pixel electrode PE and an opposing electrode opposing each other. In such an exemplary embodiment, the opposing electrode may be a previous gate line or a common line transmitting the common voltage Vcom.

In an exemplary embodiment, among elements included in the pixels R, G and B, the thin film transistor TFT is covered by the light blocking layer 376.

As illustrated in FIG. 1, the timing controller 101 receives a vertical synchronization signal Vsync, a horizontal synchronization signal Hsync, an image data signal DATA and a reference clock signal DCLK output from a graphic controller provided in a system.

An interface circuit (not illustrated) is provided between the timing controller 101 and the system and the aforementioned signals output from the system are input to the timing controller 101 through the interface circuit. The interface circuit may be embedded in the timing controller 101.

Although not illustrated, in an exemplary embodiment, the interface circuit may include a low voltage differential signaling ("LVDS") receiver, for example. The interface circuit lowers the voltage levels of the vertical synchronization signal Vsync, the horizontal synchronization signal Hsync, the image data signal DATA and the reference clock signal DCLK output from the system, while raising the frequencies thereof.

In an exemplary embodiment, electromagnetic interference ("EMI") may occur due to high frequency components of a signal input from the interface circuit to the timing controller 101. In an exemplary embodiment, to prevent the EMI, an EMI filter (not illustrated) may be further provided between the interface circuit and the timing controller 101.

The timing controller 101 generates a gate control signal GCS for controlling the gate driver 112 and a data control signal DCS for controlling the data driver 111, using the vertical synchronization signal Vsync, the horizontal synchronization signal Hsync and the reference clock signal DCLK.

In an exemplary embodiment, the gate control signal GCS includes a gate start pulse, a gate shift clock, a gate output enable signal, and the like, for example.

In an exemplary embodiment, the data control signal DCS includes a source start pulse, a source shift clock, a source output enable signal, a polarity signal POL, and the like, for example.

In addition, the timing controller 101 rearranges the image data signals DATA input through the system and applies the rearranged image data signals DATA' to the data driver 111.

In an exemplary embodiment, the timing controller 101 is driven by a driving power VCC output from a power unit provided in the system. In an exemplary embodiment, the driving power VCC is used as a power voltage of a phase lock loop ("PLL") circuit embedded in the timing controller 101, for example.

The PLL circuit compares the reference clock signal DCLK input to the timing controller 101 with a reference frequency generated from an oscillator. Then, in the case where it is determined from the comparison that there is a difference between the reference clock signal DCLK and the reference frequency, the PPL circuit adjusts the frequency of the reference clock signal DCLK by the difference to generate a sampling clock signal. The sampling clock signal is a signal for sampling the image data signals DATA'.

The power supply 177 increases or decreases the driving power VCC input through the system to generate various voltages desired for the display panel 133. In an exemplary embodiment, the power supply 177 may be a direct current to direct current ("DC-DC") converter, for example.

In an exemplary embodiment, the power supply 177 may include, for example, an output switching element for switching an output voltage of an output terminal thereof and a pulse width modulator ("PWM") for controlling a duty ratio or a frequency of a control signal applied to a control terminal of the output switching element to increase or decrease the output voltage. In another exemplary embodiment, the power supply 177 may include a pulse frequency modulator ("PFM") instead of the above-described PWM.

The PWM raises the duty ratio of the control signal to raise the output voltage of the power supply 177 or lowers the duty ratio of the control signal to lower the output voltage of the power supply 177. The pulse frequency modulator raises the frequency of the control signal to raise the output voltage of the power supply 177 or lowers the frequency of the control signal to lower the output voltage of the power supply 177. The output voltage of the power supply 177 may include a reference voltage VDD, gamma reference voltages GMA, a common voltage Vcom, a gate high voltage VGH and a gate low voltage VGL.

The gamma reference voltages GMA are voltages generated by division of the reference voltage VDD. The gamma reference voltages GMA are analog voltages, which are applied to the data driver 111.

The common voltage Vcom output from the power supply 177 is applied to the common electrode 350 of the display panel 133 through the data driver 111.

The gate high voltage VGH is a high logic voltage of the gate signal set above a threshold voltage of the thin film transistor TFT and the gate low voltage VGL is a low logic voltage of the gate signal set as an off voltage of the thin film transistor TFT. The gate high voltage VGH and the gate low voltage VGL are applied to the gate driver 112.

The gate driver 112 generates gate signals according to the gate control signal GCS provided from the timing controller 101 and sequentially applies the gate signals to the plurality of gate lines GL1 to GLi.

The gate driver 112 may include, for example, a shift register that shifts the gate start pulse according to the gate shift clock to generate gate signals. The shift register may include a plurality of switching elements. The switching elements may be formed in a non-display area of the lower substrate 301 in a substantially same process as a process in which the thin film transistor TFT positioned in a display area of the display panel is formed.

The data driver 111 receives the image data signals DATA' and the data control signal DCS from the timing controller 101. The data driver 111 samples the image data signals DATA' according to the data control signal DCS, sequentially latches the sampling image data signals corresponding to one horizontal line in each horizontal period and substantially simultaneously applies the latched image data signals to the data lines DL1 to DLj.

In an exemplary embodiment, the data driver 111 converts the image data signals DATA' from the timing controller 101 into analog image data signals using the gamma reference voltages GMA input from the power supply 177 and applies the analog image data signals to the data lines DL1 to DLj, for example.

The data driver 111 may include a gray scale generator (not illustrated), which generates a plurality of gray scale voltages using the common voltage Vcom and the gamma reference voltages GMA applied from the power supply 177. The plurality of gray scale voltages include a plurality of positive polarity gray scale voltages and a plurality of negative polarity gray scale voltages corresponding thereto. The plurality of positive polarity gray scale voltages has a voltage value greater than the common voltage Vcom, and the plurality of negative polarity gray scale voltages has a voltage value less than the common voltage Vcom. The data driver 111 converts the image data signals DATA' from the timing controller 101 into analog signals using the positive polarity gray scale voltages and the negative polarity gray scale voltages.

In an exemplary embodiment, the gray level generator may be positioned inside or outside the data driver 111.

The crosstalk determination unit 150 receives a common voltage fVcom from the display panel 133. In an exemplary embodiment, the crosstalk determination unit 150 receives the common voltage fVcom applied to the common electrode 350 of the display panel 133, for example. Hereinafter, the common voltage fVcom provided from the display panel 133 to the crosstalk determination unit 150 is defined as a feedback common voltage fVcom.

The crosstalk determination unit 150 receives the feedback common voltage fVcom and detects an effective ripple signal. The effective ripple signal is a signal having a voltage higher than a preset reference value among ripple signals of the feedback common voltage fVcom.

The crosstalk determination unit 150 compares a total number of effective ripple signals detected during one frame period with a threshold value and based on the comparison result, determines whether the effective ripple signals generated in the corresponding one frame period are crosstalk inducing signals.

In an exemplary embodiment, in the case where it is determined that the effective ripple signals of the corresponding one frame period are the crosstalk inducing signals as a result of the above comparison, the crosstalk determination unit 150 outputs a flag signal as a result of the determination, for example. In the case where it is determined that the effective ripple signals of the corresponding one frame period are not the crosstalk inducing signal, the crosstalk determination unit 150 does not output the flag signal.

Figure 4:
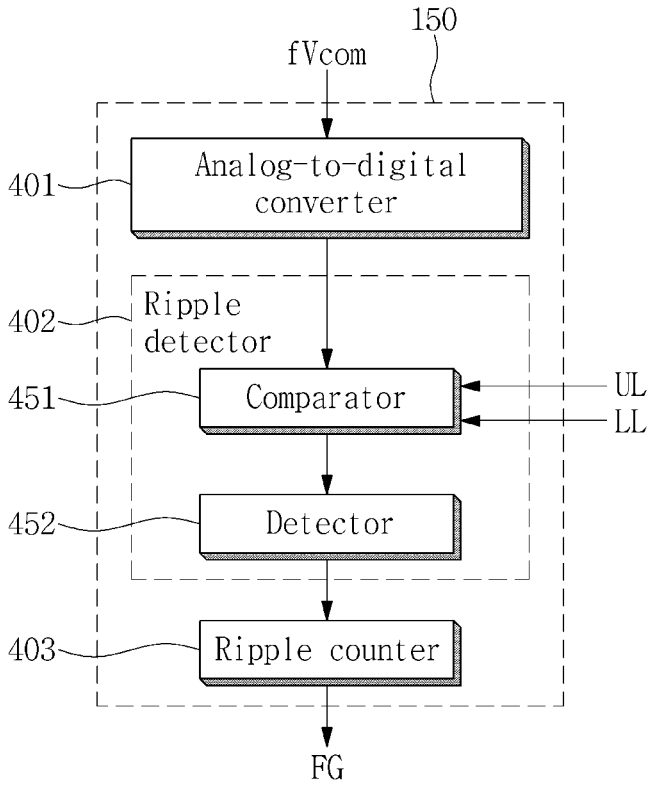
FIG. 4 is a block diagram illustrating a crosstalk determination unit of FIG. 1.

FIG. 4 is a block diagram illustrating the crosstalk determination unit 150 of FIG. 1.

As illustrated in FIG. 4, the crosstalk determination unit 150 may include an analog-digital converter ("ADC") 401, a ripple detector 402 and a ripple counter 403.

The ADC 401 digitally converts the feedback common voltage fVcom during a first frame period to generate a plurality of sampling voltages.

One frame period includes a plurality of horizontal periods and the ADC 401 digitally converts the feedback common voltage fVcom in each horizontal period of the first frame period.

In an exemplary embodiment, the ADC 401 samples the feedback common voltage fVcom n number of times in each horizontal period to generate n number of sampling voltages per horizontal period, where n is a natural number greater than 1, for example.

As an example, the ADC 401 samples the feedback common voltage fVcom n number of times during a first horizontal period of the first frame period to generate n number of sampling voltages, samples the feedback common voltage fVcom n number of times during a second horizontal period of the first frame period to generate another n number of sampling voltages, and samples the feedback common voltage fVcom n number of times during a third horizontal period of the first frame period to generate another n number of sampling voltages.

The ADC 401 digitally converts each of the n number of sampling voltages and outputs the converted sampling voltages. Unless otherwise specified, the sampling voltage output from the ADC 401 means a digital signal.

Figure 5:
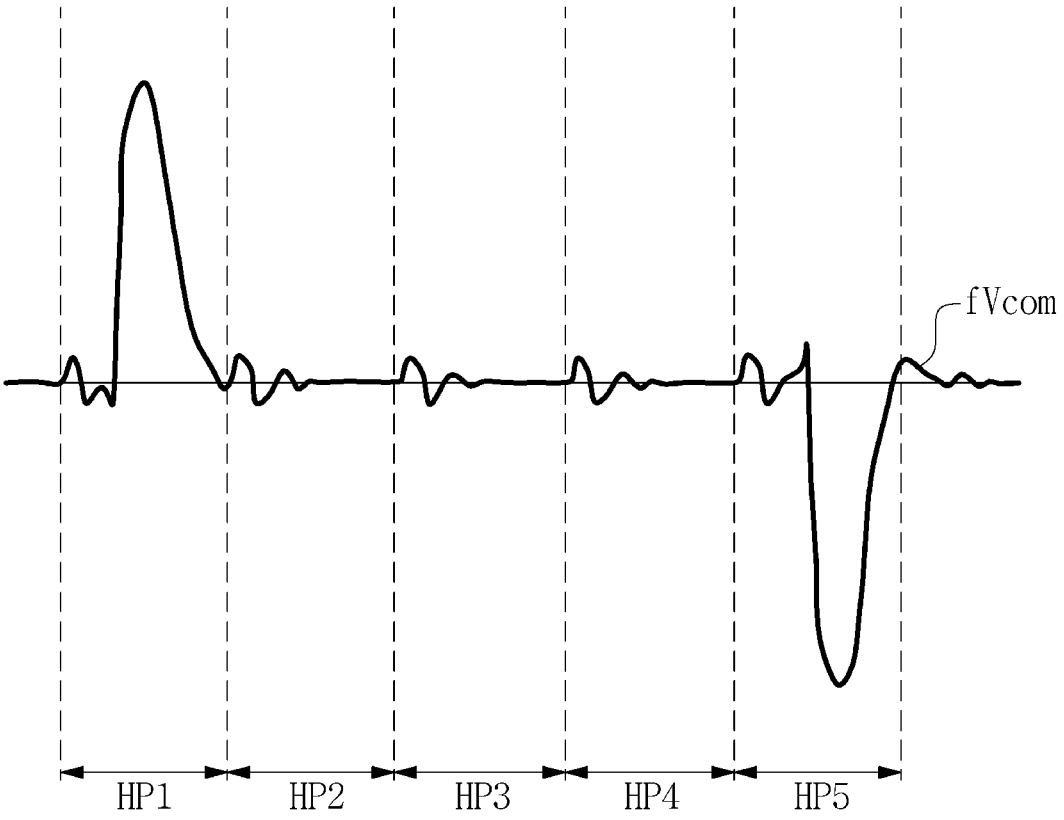
FIG. 5 is a view illustrating a waveform of a feedback common voltage input to an analog-digital converter of FIG. 4.
Figure 6A:
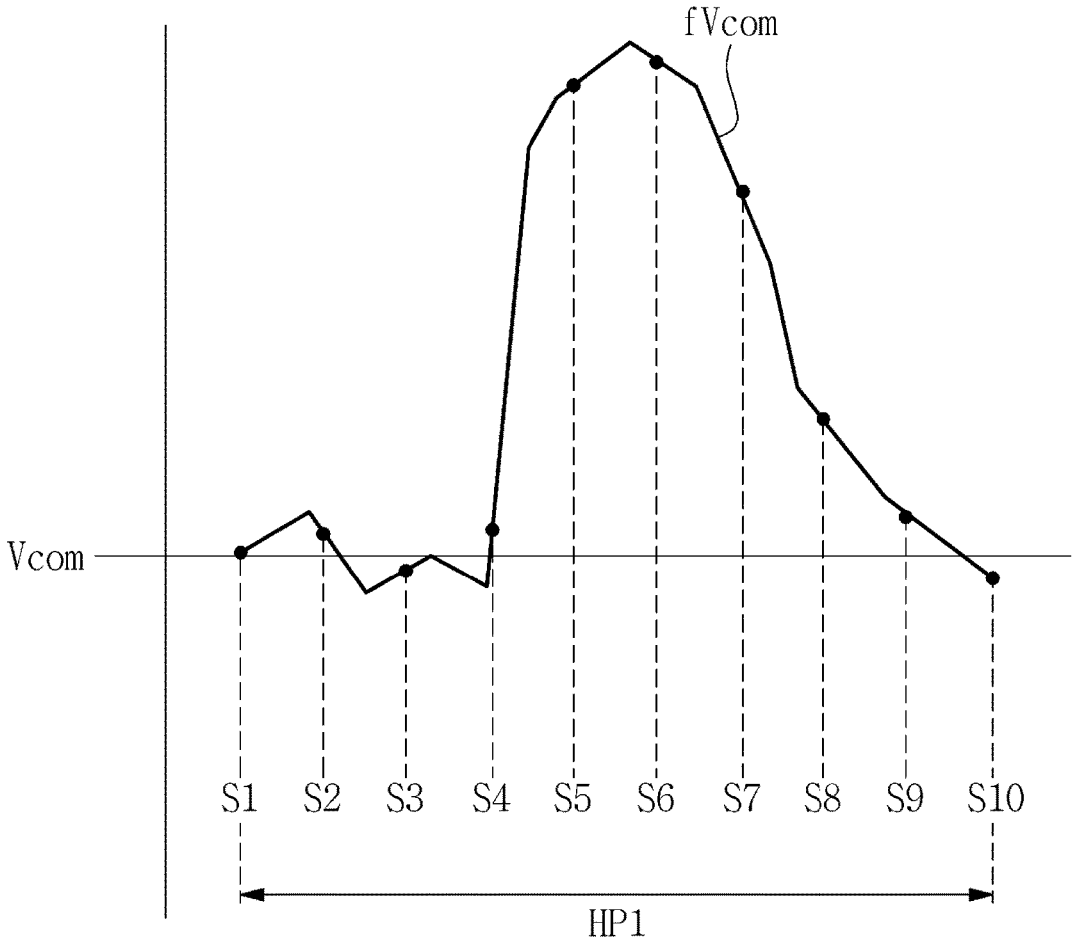
FIG. 6A is a view illustrating sampling voltages for a feedback common voltage in a first horizontal period illustrated in FIG. 5.
Figure 6B:
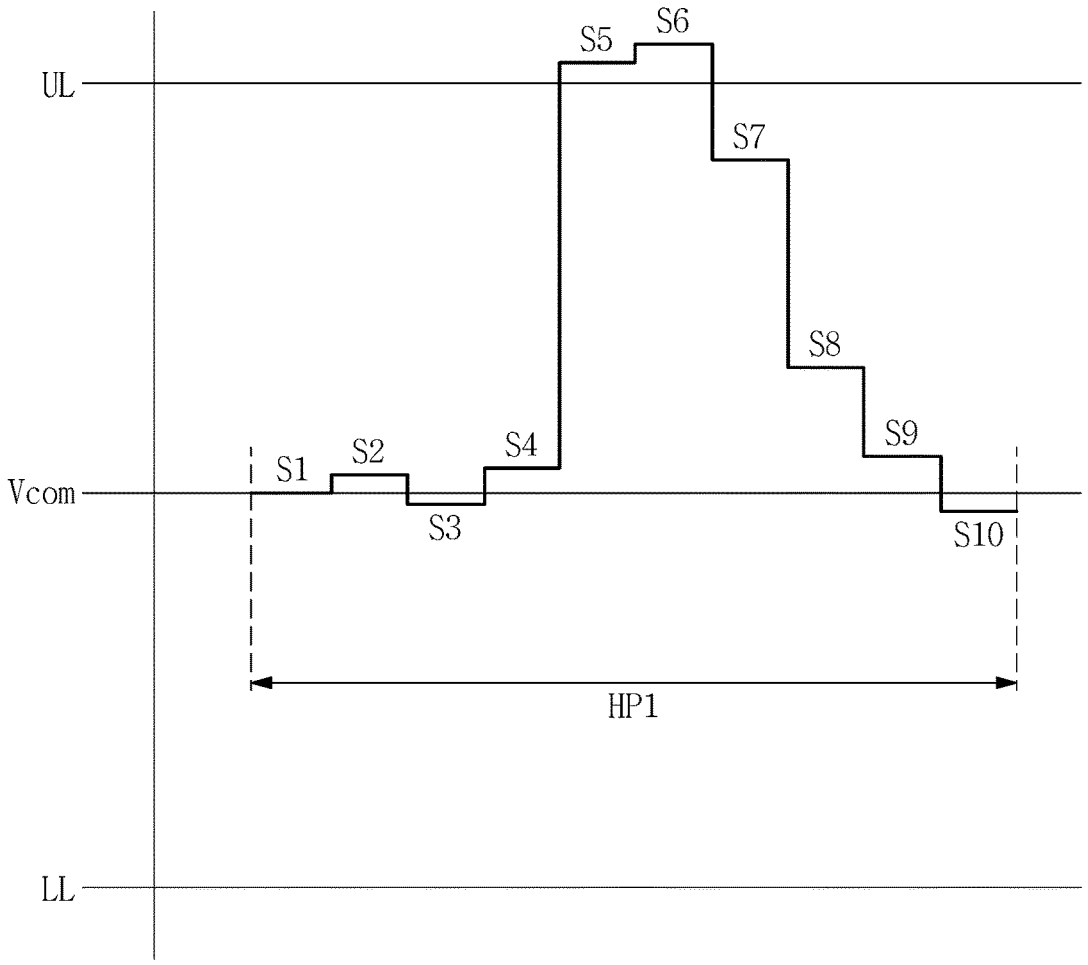
FIG. 6B is a view illustrating a digital signal for each of the sampling voltages of FIG. 6A.

FIG. 5 is a view illustrating a waveform of the feedback common voltage fVcom input to the ADC 401 of FIG. 4, FIG. 6A is a view illustrating sampling voltages S1, S2, S3, S4, S5, S6, S7, S8, S9 and S10 for the feedback common voltage fVcom in a first horizontal period HP1 illustrated in FIG. 5, and FIG. 6B is a view illustrating a digital signal for each of the sampling voltages S1, S2, S3, S4, S5, S6, S7, S8, S9 and S10 of FIG. 6A.

In FIGS. 5, 6A and 6B, an X axis represents time and a Y axis represents voltage. FIG. 5 shows several consecutive horizontal periods HP1, HP2, HP3, HP4 and HP5 among a plurality of horizontal periods included in the first frame period. Each of the horizontal periods HP1, HP2, HP3, HP4 and HP5 may have a substantially same length.

In the first horizontal period HP1, as in an example illustrated in FIGS. 6A and 6B, the ADC 401 samples the feedback common voltage fVcom ten times to generate ten sampling voltages S1, S2, S3, S4, S5, S6, S7, S8, S9 and S10.

The ripple detector 402 receives the n number of sampling voltages from the ADC 401. The ripple detector 402 individually compares each of the n number of sampling voltages with the reference value.

In an exemplary embodiment, as illustrated in FIG. 6B, the ripple detector 402 may compare a first sampling voltage S1 with the reference value, compare a second sampling voltage S2 with the reference value, . . . , and compare a tenth sampling voltage S10 with the reference value, for example.

The reference value includes an upper limit reference value UL and a lower limit reference value LL, each having different values. The upper limit reference value UL has a voltage greater than the common voltage Vcom and the lower limit reference value LL has a voltage less than the common voltage Vcom.

The ripple detector 402 compares each of the n number of sampling voltages with one of the upper limit reference value UL and the lower limit reference value LL in each horizontal period. Further, the ripple detector 402 compares each of the n number of sampling voltages with the other of the upper limit reference value UL and the lower limit reference value LL in each horizontal period.

In an exemplary embodiment, as illustrated in FIG. 6B, the ripple detector 402 compares each of first, second, third, fourth, fifth, sixth, seventh, eighth, ninth and tenth sampling voltages S1, S2, S3, S4, S5, S6, S7, S8, S9 and S10 generated in the first horizontal period HP1 with the upper limit reference value UL, individually, and compares each of the first, second, third, fourth, fifth, sixth, seventh, eighth, ninth and tenth sampling voltages S1, S2, S3, S4, S5, S6, S7, S8, S9 and S10 generated in the first horizontal period HP1 with the lower limit reference value LL, individually, for example.

The ripple detector 402 detects an effective ripple signal exceeding the reference value in each horizontal period based on the above-described comparison result.

In an exemplary embodiment, as illustrated in FIG. 6B, in the case where at least one of the first, second, third, fourth, fifth, sixth, seventh, eighth, ninth and tenth sampling voltages S1, S2, S3, S4, S5, S6, S7, S8, S9 and S10 generated in the first horizontal period HP1 is greater than the upper limit reference value UL or less than the lower limit reference value LL, the ripple detector 402 determines that the effective ripple signal is generated in the first horizontal period HP1, for example.

Accordingly, as illustrated in FIG. 6B, since the fifth sampling voltage S5 and the sixth sampling voltage S6 of the ten sampling voltages S1, S2, S3, S4, S5, S6, S7, S8, S9 and S10 generated in the first horizontal period HP1 are greater than the upper limit reference value UL, the ripple detector 402 determines that the effective ripple signal is generated in the first horizontal period HP1 and detects the effective ripple signal in the first horizontal period HP1. In the case where the effective ripple signal is detected, the ripple detector 402 outputs a detection signal in the corresponding horizontal period in which the effective ripple signal is generated.

In addition, in the following cases, the ripple detector 402 may output a detection signal.

Figure 7A:
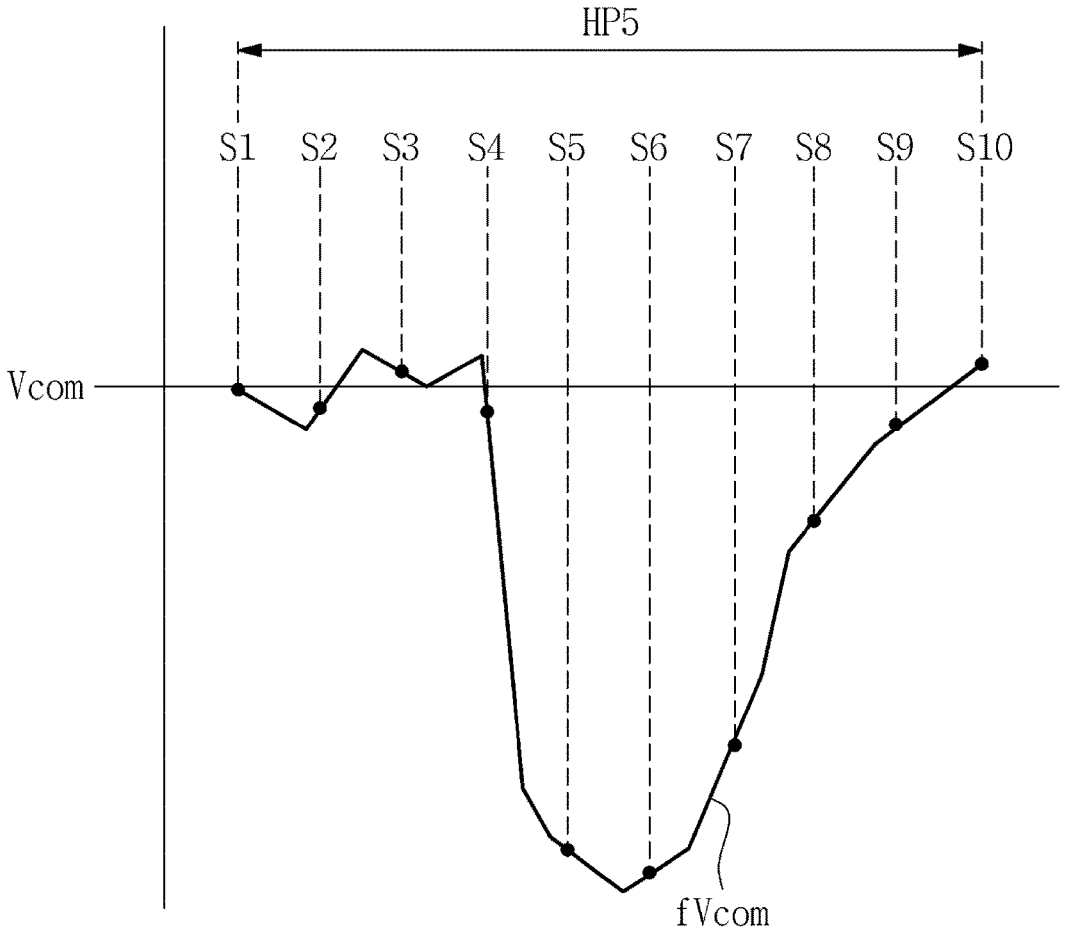
FIG. 7A is a view illustrating sampling voltages for a feedback common voltage in a fifth horizontal period illustrated in FIG. 5.
Figure 7B:
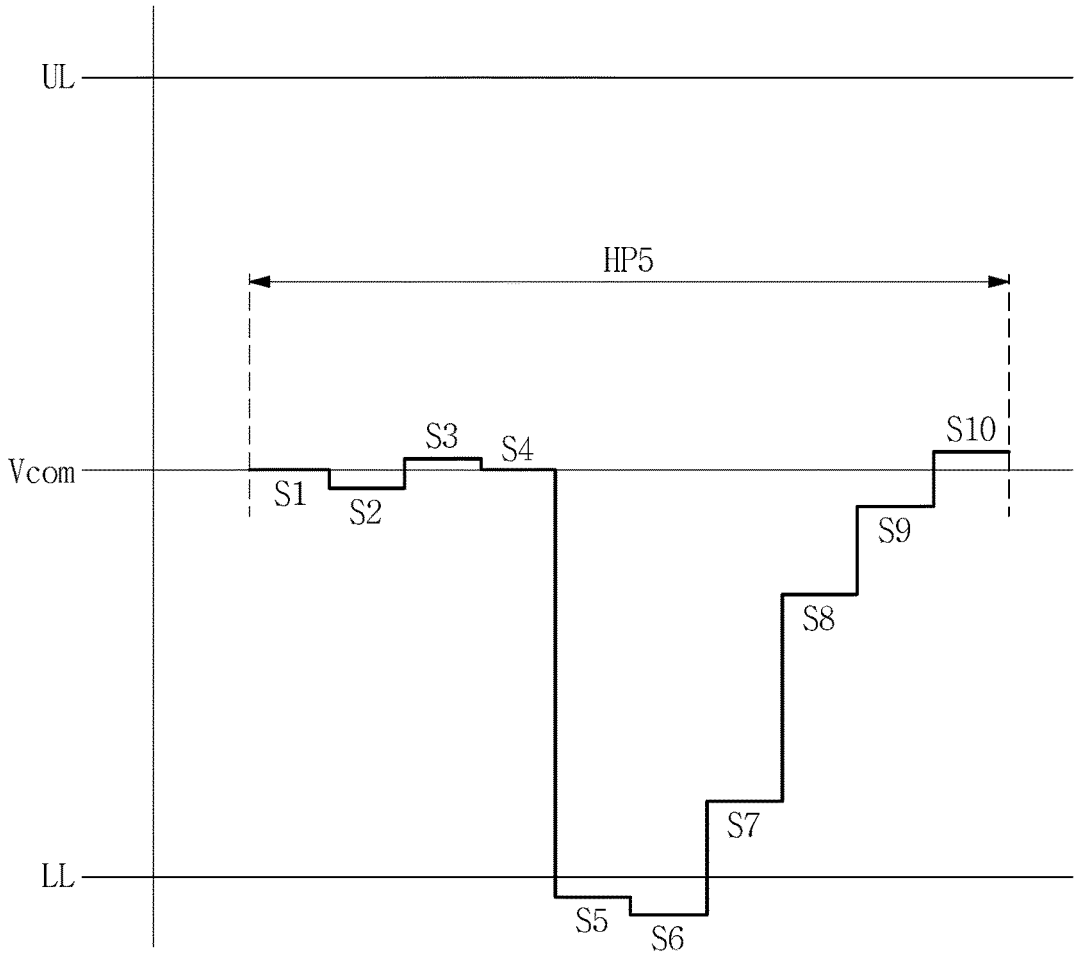
FIG. 7B is a view illustrating a digital signal for each of the sampling voltages of FIG. 7A.

FIG. 7A is a view illustrating sampling voltages S1, S2, S3, S4, S5, S6, S7, S8, S9 and S10 for the feedback common voltage fVcom in a fifth horizontal period HP5 illustrated in FIG. 5, and FIG. 7B is a view illustrating a digital signal for each of the sampling voltages S1, S2, S3, S4, S5, S6, S7, S8, S9 and S10 of FIG. 7A. In FIGS. 7A and 7B, an X axis represents time and a Y axis represents voltage.

In the fifth horizontal period HP5, as in an example illustrated in FIGS. 7A and 7B, the ADC 401 samples the feedback common voltage fVcom ten times to generate ten sampling voltages S1, S2, S3, S4, S5, S6, S7, S8, S9 and S10.

As illustrated in FIG. 7B, in the case where a fifth sampling voltage S5 and a sixth sampling voltage S6 of the ten sampling voltages S1, S2, S3, S4, S5, S6, S7, S8, S9 and S10 generated in the fifth horizontal period HP5 are less than the lower limit reference value LL, the ripple detector 402 determines that an effective ripple signal is generated in the fifth horizontal period HP5 and detects the effective ripple signal in the fifth horizontal period HP5. In the case where the effective ripple signal is detected, the ripple detector 402 outputs a detection signal in the corresponding horizontal period in which the effective ripple signal is generated.

In the case where no effective ripple signal is detected in the horizontal period, the ripple detector 402 does not output the detection signal, which will be described in detail with reference to FIGS. 8A and 8B.

Figure 8A:
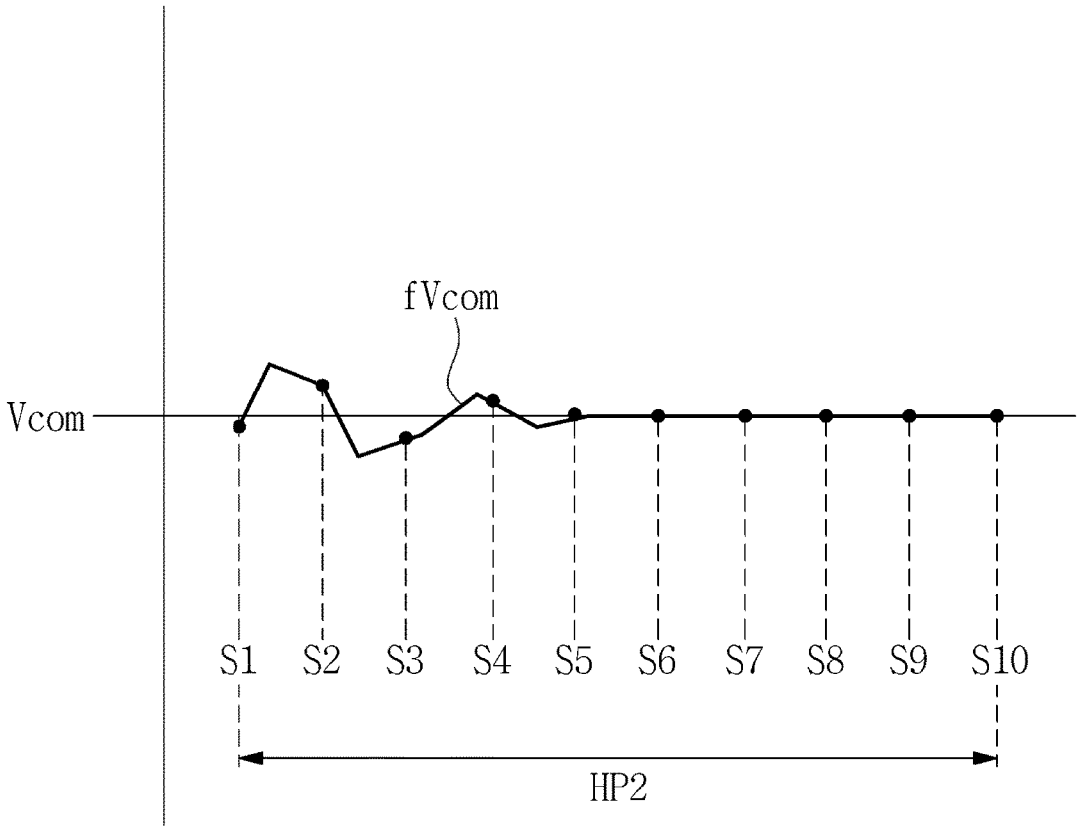
FIG. 8A is a view illustrating sampling voltages for a feedback common voltage in a second horizontal period illustrated in FIG. 5.
Figure 8B:
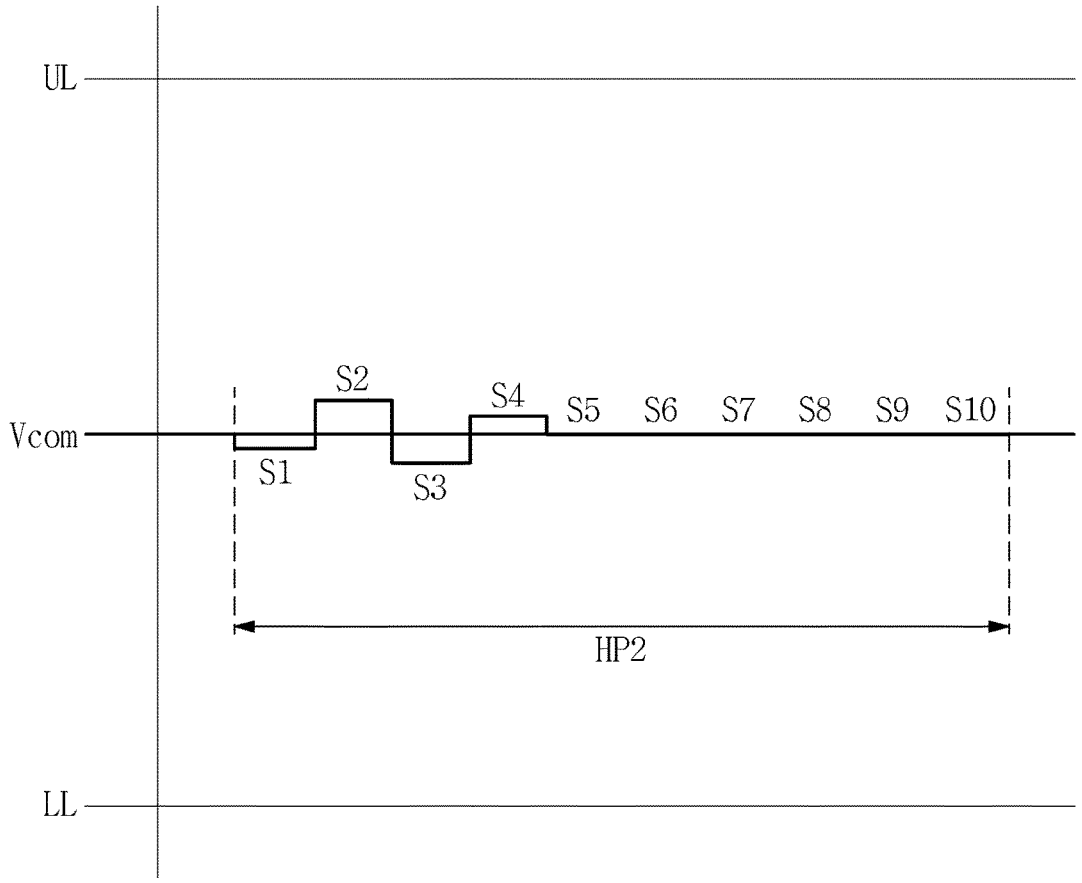
FIG. 8B is a view illustrating a digital signal for each of the sampling voltages of FIG. 8A.

FIG. 8A is a view illustrating sampling voltages S1, S2, S3, S4, S5, S6, S7, S8, S9 and S10 for the feedback common voltage fVcom in a second horizontal period HP2 illustrated in FIG. 5, and FIG. 8B is a view illustrating a digital signal for each of the sampling voltages S1, S2, S3, S4, S5, S6, S7, S8, S9 and S10 of FIG. 8A. In FIGS. 8A and 8B, an X axis represents time and a Y axis represents voltage.

In the second horizontal period HP2, as in an example illustrated in FIGS. 8A and 8B, the ADC 401 samples the feedback common voltage fVcom ten times to generate ten sampling voltages S1, S2, S3, S4, S5, S6, S7, S8, S9 and S10.

As illustrated in FIG. 8B, in the case where each of the ten sampling voltages S1, S2, S3, S4, S5, S6, S7, S8, S9 and S10 generated in the second horizontal period HP2 has a value between the upper limit reference value UL and the lower limit reference value LL, the ripple detector 402 determines that no effective ripple signal is generated in the second horizontal period HP2 and does not detect an effective ripple signal.

Accordingly, the ripple detector 402 does not output a detection signal in the second horizontal period HP2. In an exemplary embodiment, in the case where each of the ten sampling voltages S1, S2, S3, S4, S5, S6, S7, S8, S9 and S10 generated in the second horizontal period HP2 has a value substantially equal to the upper limit reference value UL or the lower limit reference value LL, the ripple detector 402 determines that no effective ripple signal is generated in the second horizontal period HP2 as well.

In order to perform such an operation, the aforementioned ripple detector 402 may include a comparator 451 and a detector 452, as illustrated in FIG. 4.

The comparator 451 receives the n number of sampling voltages from the ADC 401 and individually compares each of the n number of sampling voltages with the reference value (the upper limit reference value UL and the lower limit reference value LL).

The detector 452 detects an effective ripple signal exceeding the reference value (the upper limit reference value UL and the lower limit reference value LL) in each horizontal period based on the comparison result from the comparator 451.

The ripple counter 403 compares a total number of effective ripple signals detected by the ripple detector 402 during the first frame period with a preset threshold value, and based on the comparison result, determines whether the effective ripple signals generated in the first frame period are crosstalk inducing signals.

In the case where it is determined that the effective ripple signals of the first frame period are the crosstalk inducing signal as a result of the comparison, the ripple counter 403 outputs a flag signal FG as a result of the determination. In the case where it is determined that the effective ripple signals of the first frame period are not the crosstalk inducing signal as a result of the comparison, the ripple counter 403 does not output the flag signal FG.

Figure 9:
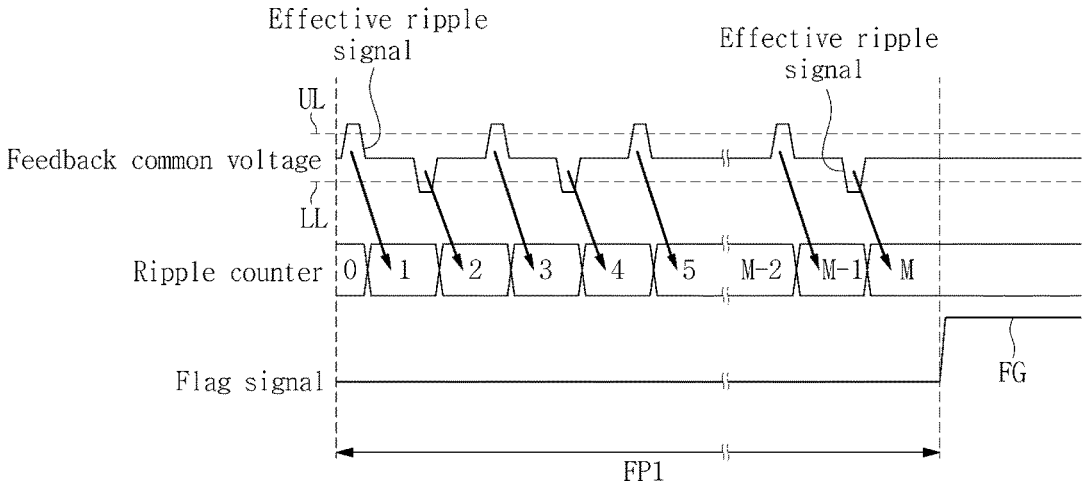
FIG. 9 is an explanatory view illustrating an operation of a ripple counter of FIG. 4.

FIG. 9 is an explanatory view illustrating the operation of the ripple counter 403 of FIG. 4.

As illustrated in FIG. 9, the ripple counter 403 counts an effective ripple signal every horizontal period of the first frame period FP1. In an exemplary embodiment, during the first frame period FP1, the ripple counter 403 (refer to FIG. 4) counts the number of effective ripple signals each time a detection signal is input from the ripple detector 402 (refer to FIG. 4) and compares the count number during the first frame period FP1 with a threshold value M, for example.

As a result of the comparison, in the case where the count number is substantially equal to or larger than the threshold value M, the ripple counter 403 outputs the flag signal FG. In an exemplary embodiment, in the case where the count number reaches the threshold value M, the ripple counter 403 outputs the flag signal FG, for example.

In the case where the count number during the first frame period FP1 is less than the threshold value M, the ripple counter 403 initializes the count value. That is, the ripple counter 403 counts the number of effective ripple signals from zero again. The flag signal FG output from the ripple counter 403 is input to the timing controller 101 (refer to FIG. 1).

The timing controller 101 determines whether to change a polarity pattern of image data signals to be applied to the display panel 133 (refer to FIG. 1) during a second frame period based on the determination result, from the ripple counter 403, in terms of the crosstalk inducing signal.

In an exemplary embodiment, in the case where it is determined that the effective ripple signals of the first frame period FP1 are the crosstalk inducing signals, the timing controller 101 outputs a control signal for changing the polarity pattern of the image data signals to be applied to the display panel 133 during the second frame period, for example. In the case where it is determined that the effective ripple signals of the first frame period FP1 are not the crosstalk inducing signal, the timing controller 101 outputs a control signal for maintaining the polarity pattern of the image data signals to be applied to the display panel 133 during the second frame period in its original state.

As an example, the timing controller 101, in response to the flag signal FG, changes a value of a polarity inversion control signal POL (refer to FIG. 1) and outputs the polarity inversion control signal POL. The polarity inversion control signal POL includes a horizontal polarity inversion control signal and a vertical polarity inversion control signal.

Figure 10:
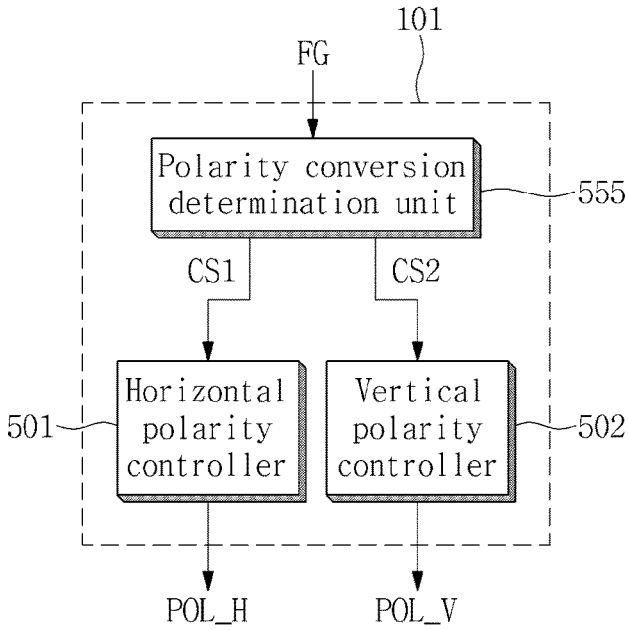
FIG. 10 is a block diagram illustrating a timing controller of FIG. 1.

FIG. 10 is a block diagram illustrating the timing controller 101 of FIG. 1.

As illustrated in FIG. 10, the timing controller 101 may include a polarity change determination unit 555, a horizontal polarity controller 501 and a vertical polarity controller 502.

The polarity change determination unit 555 outputs a first control signal CS1 and a second control signal CS2 in response to the flag signal FG from the ripple counter 403 (refer to FIG. 4). The first control signal CS1 from the polarity change determination unit 555 is applied to the horizontal polarity controller 501 and the second control signal CS2 from the polarity change determination unit 555 is applied to the vertical polarity controller 502.

The horizontal polarity controller 501 outputs a horizontal polarity inversion control signal POL_H according to the first control signal CS1, and the vertical polarity controller 502 outputs a vertical polarity inversion control signal POL_V according to the second control signal CS2. The horizontal polarity inversion control signal POL_H from the horizontal polarity controller 501 and the vertical polarity inversion control signal POL_V from the vertical polarity controller 502 are provided to the data driver 111 (refer to FIG. 1).

In response to the horizontal polarity inversion control signal POL_H, the data driver 111 changes a polarity pattern of image data signals corresponding to horizontal line pixels among the image data signals to be applied to the display panel 133 (refer to FIG. 1) during the second frame period and outputs the image data signals. In an exemplary embodiment, the data driver 111 may change a polarity pattern of image data signals of one horizontal line to be substantially simultaneously applied to j number of pixels in the first horizontal line HL1 of FIG. 2, for example.

In addition, in response to the vertical polarity inversion control signal POL_V, the data driver 111 changes a polarity pattern of image data signals corresponding to pixels in one vertical line among the image data signals to be applied to the display panel 133 during the second frame period and outputs the image data signals. In an exemplary embodiment, the data driver 111 may change a polarity pattern of image data signals of one vertical line to be sequentially applied to i number of pixels in a first vertical line VL1 of FIG. 2, for example.

Figure 11:
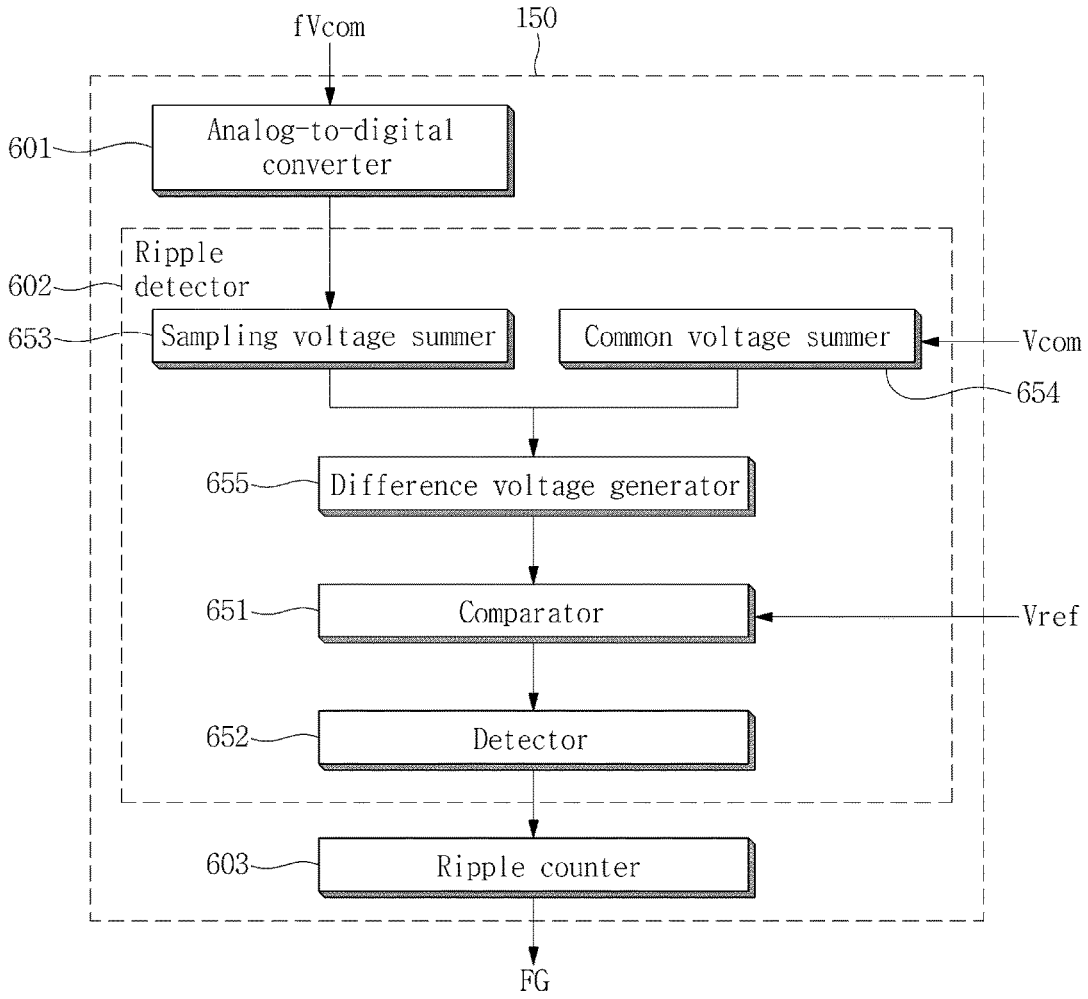
FIG. 11 is another block diagram illustrating the crosstalk determination unit of FIG. 1.

FIG. 11 is another block diagram illustrating the crosstalk determination unit 150 of FIG. 1.

As illustrated in FIG. 11, the crosstalk determination unit 150 may include an ADC 601, a ripple detector 602 and a ripple counter 603.

The ADC 601 samples the feedback common voltage fVcom n number of times in each horizontal period of the first frame period and generates n number of sampling voltages per horizontal period. The n number of sampling voltages from the ADC 601 is applied to the ripple detector 602. The ADC 601 of FIG. 11 is substantially identical to the ADC 401 of FIG. 4 described above, and thus the descriptions thereof will make reference to FIG. 4 and the related descriptions.

The ripple detector 602 adds the total n number of sampling voltages in one horizontal period provided from the ADC 601 to generate a sum sampling voltage. In an exemplary embodiment, the ripple detector 602 receives the n number of sampling voltages from the ADC 601 and adds all of the n number of sampling voltages to generate a sum sampling voltage corresponding to the corresponding one horizontal period, for example.

In addition, the ripple detector 602 generates a sum common voltage which is n times the common voltage Vcom.

Further, the ripple detector 602 generates a difference voltage corresponding to an absolute value of a difference between the sum sampling voltage and the sum common voltage.

In addition, the ripple detector 602 detects an effective ripple signal exceeding a reference value Vref in each horizontal period based on the comparison result between the difference voltage and the reference value Vref.

In order to perform such an operation, the ripple detector 602 may include a sampling voltage summer 653, a common voltage summer 654, a difference voltage generator 655, a comparator 651 and a detector 652.

The sampling voltage summer 653 adds all of the n number of sampling voltages from the ADC 601 to generate the sum sampling voltage.

In an exemplary embodiment, the sampling voltage summer 653 adds all of the n number of sampling voltages in the first horizontal period HP1 (refer to FIGS. 5, 6A and 6B) of the first frame period to generate a sum sampling voltage, and adds all of the n number of sampling voltages in the second horizontal period HP2 (refer to FIGS. 5, 8A and 8B) of the first frame period to generate another sum sampling voltage, for example. In an exemplary embodiment, as illustrated in FIG. 6B, in the case where first, second, third, fourth, fifth, sixth, seventh, eighth, ninth and tenth sampling voltages S1, S2, S3, S4, S5, S6, S7, S8, S9 and S10 are generated in the first horizontal period HP1, the sampling voltage summer 653 adds all of the first, second, third, fourth, fifth, sixth, seventh, eighth, ninth and tenth sampling voltages S1, S2, S3, S4, S5, S6, S7, S8, S9 and S10, for example. Then, a sum result S1+S2+S3+ . . . +S9+S10 obtained by adding the first, second, third, fourth, fifth, sixth, seventh, eighth, ninth and tenth sampling voltages S1, S2, S3, S4, S5, S6, S7, S8, S9 and S10 is the sum sampling voltage of the first horizontal period HP1.

The common voltage summer 654 receives the common voltage Vcom from the power supply 177 (refer to FIG. 1) to generate the sum common voltage. The sum common voltage is n times the common voltage. That is, the sum common voltage has a value corresponding to a product of the common voltage Vcom and the number of times (n) of sampling.

The difference voltage generator 655 receives the sum sampling voltage from the sampling voltage summer 653 and the sum common voltage from the common voltage summer 654. The difference voltage generator 655 calculates a difference voltage between the sum sampling voltage and the sum common voltage. The difference voltage is an absolute value.

The comparator 651 receives the difference voltage from the difference voltage generator 655. The comparator 651 compares the difference voltage with the preset reference value Vref.

The detector 652 detects an effective ripple signal exceeding the reference value Vref in each horizontal period based on the comparison result from the comparator 651 described above.

In an exemplary embodiment, in the case where the difference voltage in the first horizontal period HP1 is greater than the reference value Vref, the detector 652 determines that an effective ripple signal is generated in the first horizontal period HP1 and detects the effective ripple signal in the first horizontal period HP1, for example. In the case where the effective ripple signal is detected, the detector 652 outputs a detection signal in the corresponding horizontal period in which the effective ripple signal is generated. In the case where the difference voltage in the first horizontal period HP1 is less than or substantially equal to the reference value Vref, the detector 652 determines that no effective ripple signal is generated in the first horizontal period HP1.

The ripple counter 603 compares a total number of effective ripple signals detected by the detector 652 during the first frame period with a preset threshold value M (refer to FIG. 9) and determines whether to output a flag signal FG based on the comparison result. The ripple counter 603 of FIG. 11 is substantially identical to the ripple counter 403 of FIG. 4 described above and thus, the descriptions thereof will make reference to FIG. 4 and the related descriptions.

The flag signal FG output from the ripple counter 603 is applied to the timing controller 101 described above. The operation of the timing controller 101 in response to the flag signal FG will make reference to FIG. 9 and the related descriptions.

Figure 12:
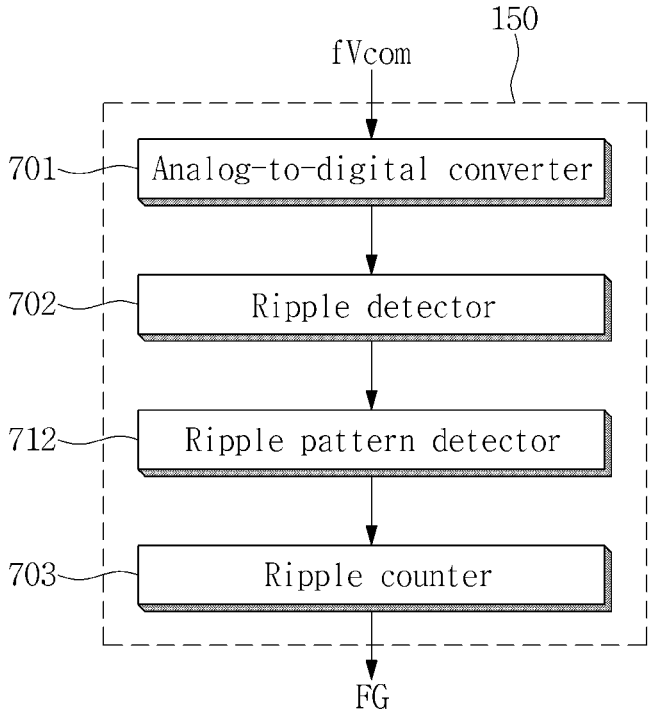
FIG. 12 is another block diagram illustrating the crosstalk determination unit of FIG. 1.

FIG. 12 is another block diagram illustrating the crosstalk determination unit 150 of FIG. 1.

As illustrated in FIG. 12, the crosstalk determination unit 150 may include an ADC 701, a ripple detector 702, a ripple pattern detector 712 and a ripple pattern counter 703.

The ADC 701 samples the feedback common voltage fVcom n number of times in each horizontal period of the first frame period to generate n number of sampling voltages per horizontal period. The ADC 701 of FIG. 12 is substantially identical to the ADC 401 of FIG. 4 described above and thus, the descriptions thereof will make reference to FIG. 4 and the related descriptions.

The ripple detector 702 detects an effective ripple signal exceeding the reference value based on the feedback common voltage fVcom digitally converted by the ADC 701. The ripple detector 702 of FIG. 12 may have a substantially same configuration as that of the ripple detector 402 of FIG. 4 or the ripple detector 602 of FIG. 11 described above. The description of the ripple detector 702 of FIG. 12 will make reference to FIG. 4 or 11 and the related descriptions.

The ripple pattern detector 712 detects an iterative ripple pattern from the effective ripple signals detected by the ripple detector 702 during the first frame period. In an exemplary embodiment, the ripple pattern detector 712 detects the iterative pattern based on a generation timing and a directivity of each of the entirety of the effective ripple signals detected during the first frame period, for example.

The generation timing of the effective ripple signal may be a horizontal period in which the effective ripple signal is generated.

The directivity of the effective ripple signal may be a polarity of the effective ripple signal. That is, the effective ripple signal may be a positive polarity effective ripple signal or a negative polarity effective ripple signal depending on the directivity.

The positive polarity effective ripple signal has a voltage greater than the common voltage Vcom and the negative polarity effective ripple signal has a voltage less than the common voltage Vcom. In an exemplary embodiment, the positive polarity effective ripple signal may be an effective ripple signal detected from the feedback common voltage fVcom in the first horizontal period HP1 of FIG. 5 and the negative polarity effective ripple signal may be an effective ripple signal detected from the feedback common voltage fVcom in the fifth horizontal period HP5 of FIG. 5, for example.

The iterative pattern may be set in advance. In an exemplary embodiment, among two effective ripple signals generated with a time difference of q horizontal periods (q being a natural number) and having opposite polarities, in the case where one of the two effective ripple signals generated relatively earlier in time is a positive polarity effective ripple signal and the other of the two effective ripple signals generated relatively later in time is a negative polarity effective ripple signal, the two effective ripple signals may be set as one iterative pattern, for example.

The ripple pattern detector 712 detects a pair of effective ripple signals that accord with the conditions of the iterative pattern described above from the effective ripple signals detected during the first frame period.

The ripple pattern counter 703 compares a total number of iterative ripple patterns detected by the ripple pattern detector 712 during the first frame period with a threshold value and based on the comparison result, the effective ripple signals of the first frame period are determined when they are crosstalk inducing signals.

Figure 13:
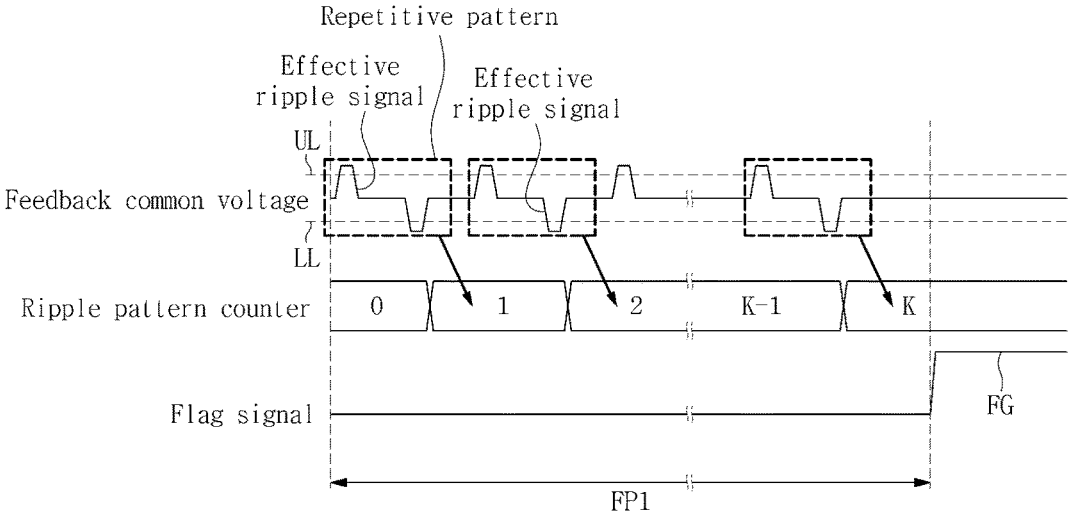
FIG. 13 is an explanatory view illustrating an operation of a ripple pattern counter of FIG. 12.

FIG. 13 is an explanatory view illustrating the operation of the ripple pattern counter 703 of FIG. 12.

As illustrated in FIG. 13, the ripple pattern counter 703 counts the iterative patterns. In an exemplary embodiment, during the first frame period FP1, the ripple pattern counter 703 stores information on the generation timing and the directivity of the effective ripple signal every time the detection signal is input from the ripple detector, for example.

When the information on the generation timing and the directivity of all of the effective ripple signals generated in the first frame period FP1 is stored, the ripple pattern counter 703 counts the iterative patterns based on the information and compares the count number with a threshold value K.

In the case where the count number is substantially equal to or larger than the above-described threshold value K as a result of the comparison, the ripple pattern counter 703 outputs a flag signal FG. In an exemplary embodiment, when the count number reaches the threshold value K, the ripple pattern counter 703 outputs the flag signal FG, for example.

In the case where the count number during the first frame period FP1 is less than the threshold value K, the ripple pattern counter 703 initializes the count number. The flag signal FG output from the ripple pattern counter 703 is input to the timing controller 101 (refer to FIG. 1).

The flag signal FG output from the ripple pattern counter 703 is applied to the timing controller 101 described above. The operation of the timing controller 101 in response to the flag signal FG will make reference to FIG. 9 and the related descriptions.

In an exemplary embodiment, the ripple detectors 402 (refer to FIG. 4), 602 (refer to FIG. 11) and 702 and the ripple counters 403 (refer to FIG. 4), 603 (refer to FIG. 11) and 703 described above may be embedded in the timing controller 101.

In an alternative exemplary embodiment, the ripple detectors 402, 602 and 702, the ripple counters 403, 603 and 703 and the ADCs 401 (refer to FIG. 4), 601 (refer to FIG. 11) and 701 may be embedded in the timing controller 101.

In another alternative exemplary embodiment, the ADCs 401, 601 and 701 may be embedded in the power supply 177 (refer to FIG. 1), and the ripple detectors 402, 602 and 702 and the ripple counters 403, 603 and 703 may be embedded in the timing controller 101.

In another alternative exemplary embodiment, the ADCs 401, 601 and 701 may be embedded in the display panel 133 in the form of an integrated circuit, for example, and the ripple detectors 402, 602 and 702 and the ripple counters 403, 603 and 703 may be embedded in the timing controller 101.

In addition, the ripple pattern counter 703 may be embedded in the timing controller 101.

Figure 14:
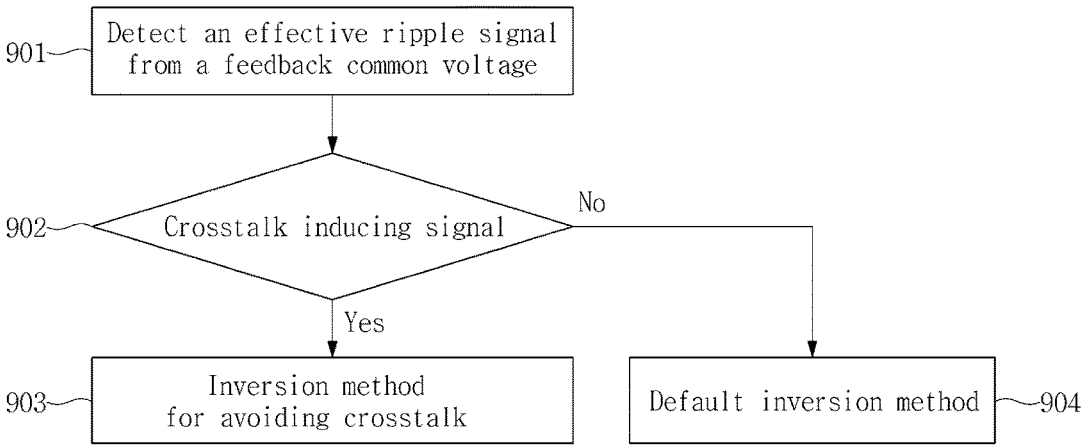
FIG. 14 is an explanatory view illustrating an exemplary embodiment of a method of driving a display device.

FIG. 14 is an explanatory view illustrating a method of driving a display device according to an exemplary embodiment.

First, the display device detects an effective ripple signal (901). In an exemplary embodiment, the display device digitally converts the feedback common voltage fVcom (refer to FIGS. 1 and 5) from the display panel 133 (refer to FIG. 1) to generate n number of sampling voltages per horizontal period, for example. Then, the display device finds the effective ripple signal exceeding a reference value based on the n number of sampling voltages, in each horizontal period.

The display device then determines whether the effective ripple signals detected during the first frame period are crosstalk inducing signals (902).

In the case where it is determined that the effective ripple signals of the first frame period are crosstalk inducing signals, the display device changes a polarity pattern of image data signals to be applied to the display panel 133 during the second frame period. That is, the display device selects an inversion scheme to substantially avoid crosstalk (903).

In the case where it is determined that the effective ripple signals of the first frame period are not the crosstalk inducing signal, the display device maintains the polarity pattern of the image data signals to be applied to the display panel 133 during the second frame period in its original state, for example. That is, the display device selects a default inversion scheme (904).

As set forth hereinabove, the LCD device and the method of driving the LCD device according to one or more exemplary embodiments may provide the following effects.

The presence of a crosstalk inducing signal may be detected based on the effective ripple signal detected from the feedback common voltage and an inversion driving scheme capable of substantially avoiding crosstalk may be performed according to the detection result.

That is, when a specific image pattern generating crosstalk is displayed, the feedback common voltage varies accordingly, and thus the display device according to one or more exemplary embodiments may determine whether the crosstalk occurs based on the effective ripple signals of the feedback common voltage.

While the invention has been illustrated and described with reference to the exemplary embodiments thereof, it will be apparent to those of ordinary skill in the art that various changes in form and detail may be made thereto without departing from the spirit and scope according to an exemplary embodiment.

What is claimed is:

1. A method of driving a display device, the method comprising:

applying a common voltage to a display panel of the display device;

digitally converting a feedback common voltage from the display panel;

detecting an effective ripple signal exceeding a reference value based on the digitally converted feedback common voltage;

comparing a total number of effective ripple signals detected during a first frame period with a threshold value;

determining whether the effective ripple signals of the first frame period are crosstalk inducing signals based on a comparison result; and determining whether to change a polarity pattern of image data signals to be applied to the display panel during a second frame period based on a determination result in terms of the crosstalk inducing signal.

2. The method as claimed in claim 1, wherein the digitally converting the feedback common voltage comprises:

sampling the feedback common voltage n number of times, where n being a natural number greater than 1, in each horizontal period of the first frame period to generate n number of sampling voltages in one horizontal period.

3. The method as claimed in claim 2, wherein the detecting the effective ripple signal exceeding the reference value comprises:

individually comparing each of the n number of sampling voltages with the reference value in each horizontal period of the first frame period; and detecting the effective ripple signal exceeding the reference value in each horizontal period based on the comparison result between each of the n number of sampling voltages and the reference value.

4. The method as claimed in claim 3, wherein the reference value comprises:

an upper limit reference value having a value greater than the common voltage; and a lower limit reference value having a value less than the common voltage.

5. The method as claimed in claim 4, wherein the individually comparing each of the n number of sampling voltages with the reference value in each horizontal period of the first frame period comprises:

comparing each of the n number of sampling voltages with one of the upper limit reference value and the lower limit reference value in each horizontal period; and comparing each of the n number of sampling voltages with the other of the upper limit reference value and the lower limit reference value in each horizontal period.

6. The method as claimed in claim 5, wherein the detecting the effective ripple signal exceeding the reference value comprises:

detecting, when any one of the n number of sampling voltages is greater than the upper limit reference value or less than the lower limit reference value, the effective ripple signal in a corresponding horizontal period.

7. The method as claimed in claim 1, wherein the determining whether the effective ripple signals of the first frame period are crosstalk inducing signals comprises:

counting the total number of effective ripple signals in each horizontal period of the first frame period; and comparing the total number of counted effective ripple signals with the threshold value.

8. The method as claimed in claim 7, wherein the determining whether the effective ripple signals of the first frame period are crosstalk inducing signals further comprises:

determining that the effective ripple signals of the first frame period are the crosstalk inducing signals when the total number of the counted effective ripple signals reaches the threshold value.

9. The method as claimed in claim 2, wherein the detecting the effective ripple signal exceeding the reference value comprises:

adding all of the n number of sampling voltages in one horizontal period to generate a sum sampling voltage;

generating a sum common voltage which is n times the common voltage;

generating a difference voltage corresponding to an absolute value of a difference between the sum sampling voltage and the sum common voltage;

comparing the difference voltage with the reference value; and detecting the effective ripple signal exceeding the reference value in each horizontal period based on a comparison result between the difference voltage and the reference value.

10. The method as claimed in claim 9, wherein the detecting the effective ripple signal exceeding the reference value further comprises:

detecting, when the difference voltage is greater than the reference value, the effective ripple signal in a corresponding horizontal period.

11. A method of driving a display device, the method comprising:

applying a common voltage to a display panel of the display device;

digitally converting a feedback common voltage from the display panel;

detecting an effective ripple signal exceeding a reference value based on the digitally converted feedback common voltage;

detecting an iterative ripple pattern from effective ripple signals detected during a first frame period;

comparing a total number of iterative ripple patterns detected during the first frame period with a threshold value;

determining whether the effective ripple signals of the first frame period are crosstalk inducing signals based on a comparison result; and determining whether to change a polarity pattern of image data signals to be applied to the display panel during a second frame period based on a determination result in terms of the crosstalk inducing signal.

12. The method as claimed in claim 1, wherein the determining whether the effective ripple signals of the first frame period are crosstalk inducing signals comprises:

counting the total number of iterative ripple patterns during the first frame period; and comparing the total number of counted iterative ripple patterns with the threshold value.

13. The method as claimed in claim 12, wherein the determining whether the effective ripple signals of the first frame period are crosstalk inducing signals further comprises:

determining that the effective ripple signals of the first frame period are the crosstalk inducing signals when the total number of the counted iterative ripple patterns reaches the threshold value.

14. A display device comprising:

a display panel;

a power supply which applies a common voltage to the display panel;

an analog-digital converter which digitally converts a feedback common voltage from the display panel;

a ripple detector which detects an effective ripple signal exceeding a reference value based on the feedback common voltage digitally converted by the analog-digital converter;

a ripple counter which compares a total number of effective ripple signals detected by the ripple detector during a first frame period with a threshold value and determines whether the effective ripple signals of the first frame period are crosstalk inducing signals based on a comparison result; and a timing controller which determines whether to change a polarity pattern of image data signals to be applied to the display panel during a second frame period based on a determination result, from the ripple counter, in terms of the crosstalk inducing signal.

15. The display device as claimed in claim 14, wherein the analog-digital converter samples the feedback common voltage n number of times, where n being a natural number greater than 1, in each horizontal period of the first frame period to generate n number of sampling voltages in one horizontal period.

16. The display device as claimed in claim 15, wherein the ripple detector comprises:

a comparator which individually compares each of the n number of sampling voltages with the reference value in each horizontal period of the first frame period; and a detector which detects an effective ripple signal exceeding the reference value in each horizontal period based on the comparison result from the comparator.

17. The display device as claimed in claim 16, wherein the reference value comprises:

an upper limit reference value having a value greater than the common voltage; and a lower limit reference value having a value less than the common voltage.

18. The display device as claimed in claim 17, wherein the comparator compares each of the n number of sampling voltages with one of the upper limit reference value and the lower limit reference value in each horizontal period and, compares each of the n number of sampling voltages with the other of the upper limit reference value and the lower limit reference value in each horizontal period.

19. The display device as claimed in claim 15, wherein the ripple detector comprises:

a sampling voltage summer which adds all of the n number of sampling voltages provided from the analog-digital converter in one horizontal period to generate a sum sampling voltage;

a common voltage summer which receives the common voltage from the power supply to generate a sum common voltage which is n times the common voltage;

a difference voltage generator which generates a difference voltage corresponding to an absolute value of a difference between the sum sampling voltage from the sampling voltage summer and the sum common voltage from the common voltage summer;

a comparator which compares the difference voltage from the difference voltage generator with the reference value; and a detector which detects the effective ripple signal exceeding the reference value in each horizontal period based on the comparison result from the comparator.

20. A display device comprising:

a display panel;

a power supply which applies a common voltage to the display panel;

an analog-digital converter which digitally converts a feedback common voltage from the display panel;

a ripple detector which detects an effective ripple signal exceeding a reference value based on the feedback common voltage digitally converted by the analog-digital converter;

a ripple pattern detector which detects an iterative ripple pattern from effective ripple signals detected by the ripple detector during a first frame period;

a ripple pattern counter which compares a total number of iterative ripple patterns detected by the ripple pattern detector during the first frame period with a threshold value and determines whether the effective ripple signals of the first frame period are crosstalk inducing signals based on a comparison result; and a timing controller which determines whether to change a polarity pattern of image data signals to be applied to the display panel during a second frame period based on a determination result, from the ripple pattern counter, in terms of the crosstalk inducing signal.

* * * * *